United States Patent [19]

Frey

[11] 4,128,120

[45] Dec. 5, 1978

[54] TAMBOUR DOOR AND HOUSING ASSEMBLY

[75] Inventor: Frederick J. Frey, Conway, Ark.

[73] Assignee: InterRoyal Corporation, New York, N.Y.

[21] Appl. No.: 825,365

[22] Filed: Aug. 17, 1977

[51] Int. Cl.[2] ..... E05F 11/54

[52] U.S. Cl. ..... 160/191; 16/197; 160/235

[58] Field of Search ..... 160/191, 192, 235, 196; 16/197, 193

[56] References Cited

U.S. PATENT DOCUMENTS

| | | | |
|---|---|---|---|
| 1,220,910 | 3/1917 | Toll | 160/196 |
| 2,090,099 | 8/1937 | Bittorf et al. | 160/191 |
| 2,817,872 | 12/1957 | Foster | 16/197 |
| 2,850,088 | 9/1958 | Purdy | 160/235 X |
| 3,150,420 | 9/1964 | Brenner | 16/197 |
| 3,869,754 | 3/1975 | Foster | 16/197 |

FOREIGN PATENT DOCUMENTS

| | | | |
|---|---|---|---|
| 948720 | 2/1964 | United Kingdom | 160/235 |

*Primary Examiner*—Philip C. Kannan
*Attorney, Agent, or Firm*—Arthur A. March

[57] ABSTRACT

A tambour or roll-top door and housing assembly comprises a tambour door formed of a plurality of longitudinal segments engaged along their adjacent sides by parallel hinge elements, and a housing having a pair of spaced tracks defining a curved path, the door being positioned with its side edges engaging the two tracks respectively and the segments being relatively pivotable when the door slides around the curve between open and closed positions. The assembly further includes a gear having a circular pitch distance between teeth corresponding to the pitch between the door's hinged segments, the gear being rotatable on a shaft with at least one tooth always engaging one door segment, and a Negator$_{tm}$ spring having one end secured to the bottom of the door and the remaining spiral portion freely rotatable on the gear shaft. Movement of the door toward either closed or open position causes the Negator spring to be further wound or unwound, this spring having the characteristic of constant torque regardless of the degree of winding, so that the door is effectively counter-balanced in all positions.

10 Claims, 5 Drawing Figures

TAMBOUR DOOR AND HOUSING ASSEMBLY

BACKGROUND OF THE INVENTION

Tambour or roll-top door concepts are used in certain furniture such as roll-top desks, in certain trucks and garages, in curtains in theatres. Such tambour door concepts or structures provide a compact means for closing a space without requiring a typical one-piece door that swings in an arc about a hinge; furthermore a tambour door, when opened, may be slid into a recess within the assembly where it is conveniently hidden. Another feature of these doors is the potential attractiveness made possible by the plurality of separate segments hinged together.

It should be noted that in the typical applications described above, these tambour doors slide in a curved track from a first closed position wherein the segments are aligned as a generally vertical wall, upward around a curved portion of the track, to an open position wherein the segments are aligned in a generally horizontal or other orientation. In many instances these doors are quite large and heavy and consequently are difficult to move; in particular it is difficult to get the door started in its movement and equally difficult to stop the door after it has begun moving due to the high inertia force. Very heavy doors may be impossible to move by hand without supplemental spring or motor drive means, and similarly it may be impossible to stop the doors and prevent a crashing impact without supplemental means. Furthermore it may be quite dangerous for such doors to be operated without means to prevent uncontrolled movement once they are started in their movement.

The prior art solutions to the above described problems involve a variety of different counter-balancing or counter-weight mechanisms which attempt to set up a force which is generally equal to the weight of the door, so that movement of the door is possible by the addition of a very small additional force to simply unbalance the counter-weighted system. Counter-weighting can be done in the simple manner of having a pulley arrangement with an actual weight posed in opposition to the weight of the door. Also a variety of springs may be considered, however the normal problem with springs is that they tend to develop greater resistance with greater extension according to Hooke's law. Accordingly a spring would provide different forces depending upon the position of the door, and consequently such systems sometimes use two or more springs each operable at different positions of the door, as means for preloading the door to be at least partially counterbalanced. The descriptions herein concern doors that are manually operated; in the case of power driven doors, the drive mechanism may or may not include inherent brake features which would make it unnecessary to pre-load a door to prevent it from moving after the driving force has stopped.

In a still different arrangement, there are compression springs arranged to engage a lever on the door when it has arrived at either of its extreme closed or open positions; the engagement occurs as the door approaches the final position whereupon a spring is compressed, thus cushioning the door from impacting at the time of closing or opening. This is particularly useful for theatre curtains where it is important to avoid a loud thud or crashing noise when the curtain falls.

In summary, the prior art spring mechanisms tend to be operable only during part of the door's travel until the spring becomes wound or flexed, or else a complex arrangement of multiple springs with means to disengage them at appropriate times is required; alternatively pulley arrangements with weights are required to truly counter-balance the door at all times. The present invention provides a new mechanism and arrangement for counter-balancing the door at all positions of its travel and thus providing the benefits of a counter-balanced pulley system and a pre-loaded spring system; very little force is required to initiate or maintain movement of the door in either direction, and the door is counter-balanced between its own weight and the spring force causing it to remain relatively stable when no external force is applied. A summary of the new invention and a detailed description of the preferred embodiment thereof follows below.

SUMMARY OF THE INVENTION

This invention is a tambour door and housing assembly wherein the housing includes a pair of spaced apart tracks defining between them a path having a generally vertical first section with top and bottom parts, a generally horizontal second section near the top part of the first section, and a curved third section interconnecting the first and second sections. The tambour door has top and bottom parts, and side edges which are slidably disposed in the tracks of the housing, the door being movable along the path so defined. The door comprises a plurality of longitudinal segments each having opposite ends which define the side edges of the door; these segments are situated side-by-side with their adjacent edges pivotally engaged in a hinge coupling with a pitch distance P between the couplings In combination with the above housing and door assembly, there is a new counter-balancing system which comprises a shaft mounted in the housing and oriented generally parallel to the door segments. A gear is mounted rotatably on the shaft, the gear having teeth with a circular pitch distance between the teeth corresponding to the pitch P of the door couplings, with the gear situated such that the teeth thereof each engage one door coupling successively as the door moves in the path and the gear rotates. A Negator spring has an upper end coiled and freely rotatable about the shaft and a lower end secured to the bottom part of the door, whereby the door is subject to an essentially constant force from the spring urging the door to move in the path regardless of the location of the door along the path. It is important that the upper part of the spring be freely rotatable on a shaft, but the shaft need not necessarily be the same shaft as the one on which the gear rotates. Furthermore the gear could be omitted as regards the counter-balancing feature, however it is useful to help guide the segments of the door around the curved portion of the path.

This invention is operable with doors that move from a vertical to a horizontal position above the vertical, or to a horizontal position below the vertical, or that move in a variety of other orientations. In a typical arrangement where the door in a vertical orientation closes a space in a housing, and when slid upward to a horizontal orientation exposes the space, it is useful for the spring force to be generally equal to or slightly less than the downward force exerted by the door in the path. The effective downward force of the door due to its weight will vary depending upon what portion of the door is in a downward orientation as compared to the remaining portion in a horizontal orientation, simply lying in the track. As a greater portion of the door has risen and is in the horizontal track the downward force of the door will be less, and therefore it may be advisable for the constant spring force to be somewhat less than the maximum door force, so that the spring does not independently raise a partially elevated door. A tambour door as thus described will be sufficiently counter-balanced that only a relatively small force will be required to initiate motion or to stop ongoing motion of the door.

DETAILED DESCRIPTION OF THE PREFERRED EMBODIMENT

Figure 1:
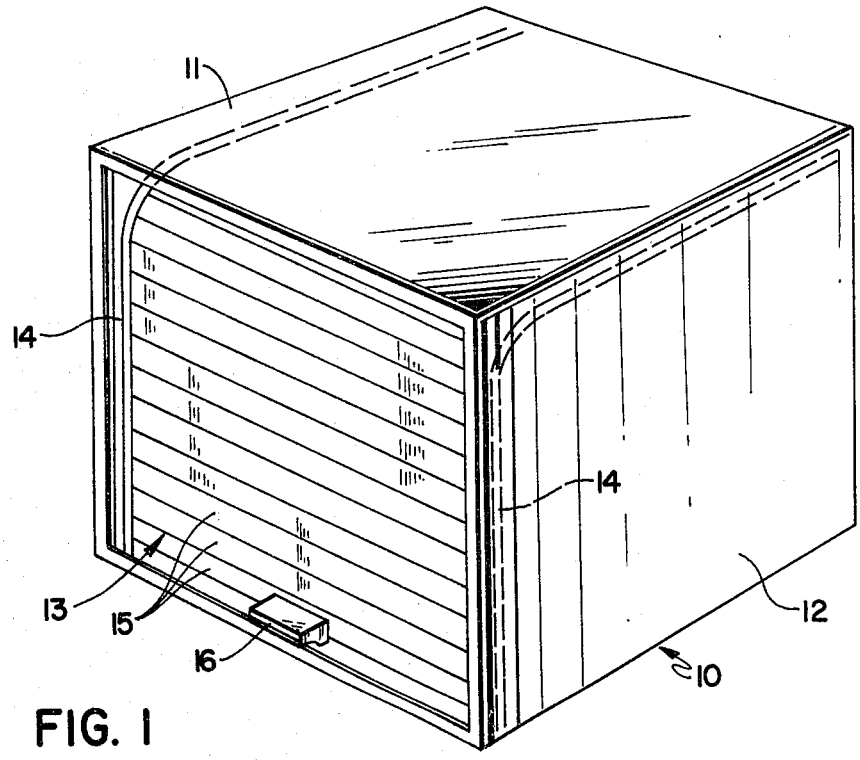
FIG. 1 is a perspective view of a cabinet with a tambour or roll-top door of the present invention.

FIG. 1 shows a cabinet or the like 10 having a top part 11, sides 12, and a front door of the tambour or roll-top type 13. Along the front and top edges of the inside surface of each sidewall 12 is a track 14 in which the edges of door 13 slide. The door is comprised of a plurality of horizontal segments 15 which are hingedly engaged to each other, as shown in greater detail in FIGS. 4 and 5. On the front of door 13 near the lower part thereof is a handle 16 which is used for manually raising and lowering the door.

Figure 2:
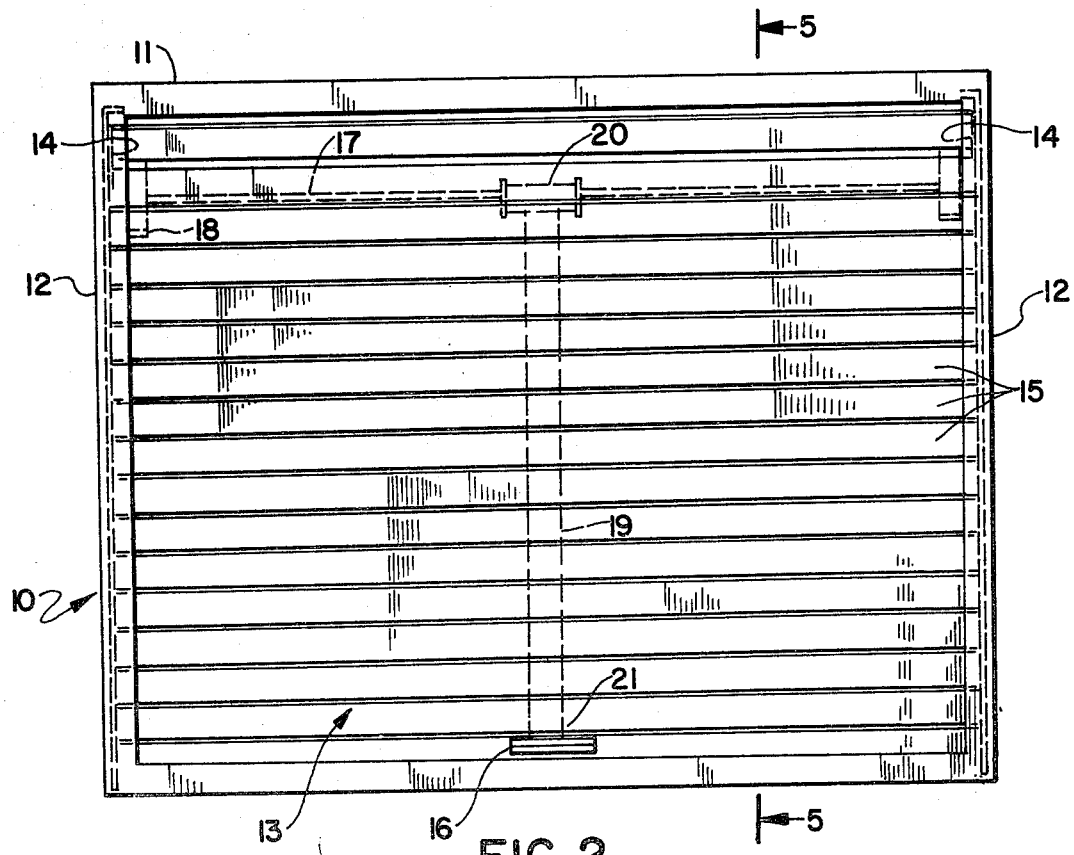
FIG. 2 is a front elevation view of the structure of FIG. 1.

FIG. 2 is a front elevation view of the cabinet of FIG. 1 with corresponding top and side walls 11 and 12 respectively. The segments or slats 15 of the tambour door 13 have their end parts disposed in track 14 for free movement therein. As shown in dotted line to indicate it is situated behind the door, is a shaft 17 extending the width of the door with ends thereof mounted to permit rotation of the shaft, and a gear 18 attached near each end of the shaft. The teeth 32 of the gear engage the door as shown more clearly in FIG. 5. Near the center of the door is a spring 19 having one end 20 coiled as a spiral about shaft 17 and freely rotatable thereon, and the other end 21 secured to the door near the bottom thereof and generally opposite handle 16 which is mounted on the front of the door.

Figure 3:
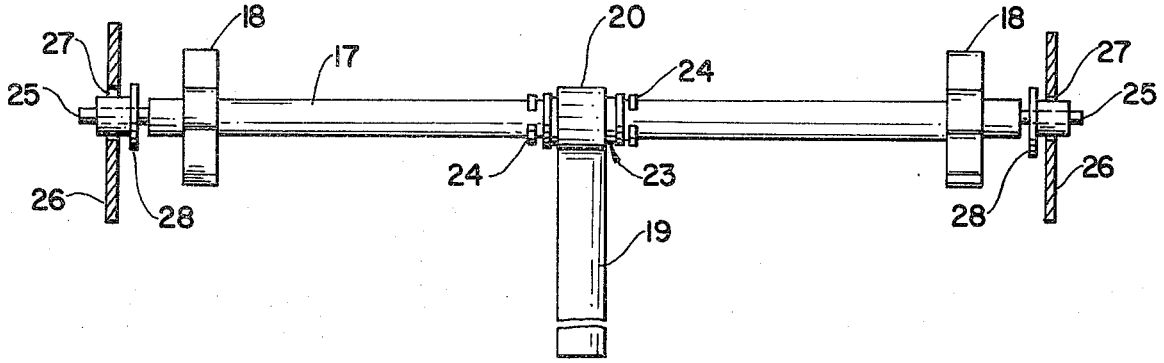
FIG. 3 is an elevation view of the shaft supporting the drive gear and Negator spring components of the new invention which is partially shown in FIG. 2.

FIG. 3 illustrates the detailed structure of the shaft 17, gear 18, and spring 19 shown in FIG. 2. Shaft 17 has square cross section and ends 25 in bearing mounts. More specifically there is a mounting plate 26 with an aperture 27 and bushing 28 situated in the aperture and about the end 25 of the shaft. The mounting arrangement is the same on both ends of the shaft, with the gear 18 near each end to generally balance the mechanism. To assure that the spiraled end 20 of the spring 19 is freely rotatable on shaft 17 there is an intermediate spool 23 axially restricted by retainers 24. This spring is a constant torque type sold commonly under the name NEGATOB and has the characteristics of exerting a constant force no matter how much it is extended. Thus the force tending to rewind lower end 21 relative to the wound portion 20 is the same regardless of the position of the door and therefore regardless of the extension of the spring. As will be explained more fully in later paragraphs, this spring has the effect of being a counter-balance for all positions of the door and is effectively a pre-load force on the door in one direction regardless of its position.

Figure 4:
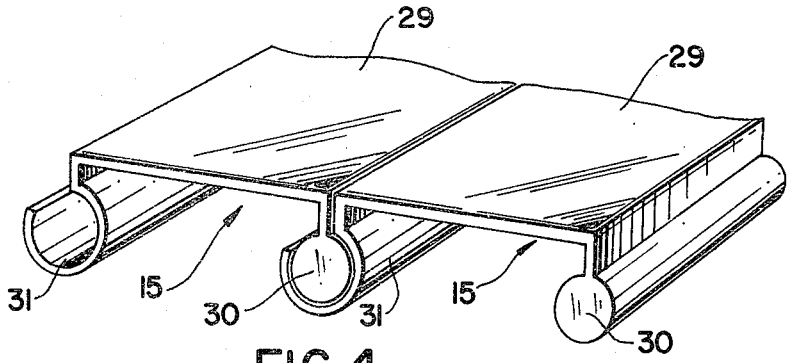
FIG. 4 is a perspective view of two segments of the tambour door formed of a plurality of such segments.

FIG. 4 is a fragmentary view of two metal or plastic sections 15 of which the tambour or roll-top door is composed. Each section has a web part 29 extending the width of the door, a rod part 30, and a coupling part 31. As shown the coupling part 31 of each section surrounds and hingedly engages the rod part 30 of the adjacent section. This allows the door to pivot about each two sections, so that the end parts of the door can easily navigate the curved track 14 illustrated more clearly in FIG. 5.

Figure 5:
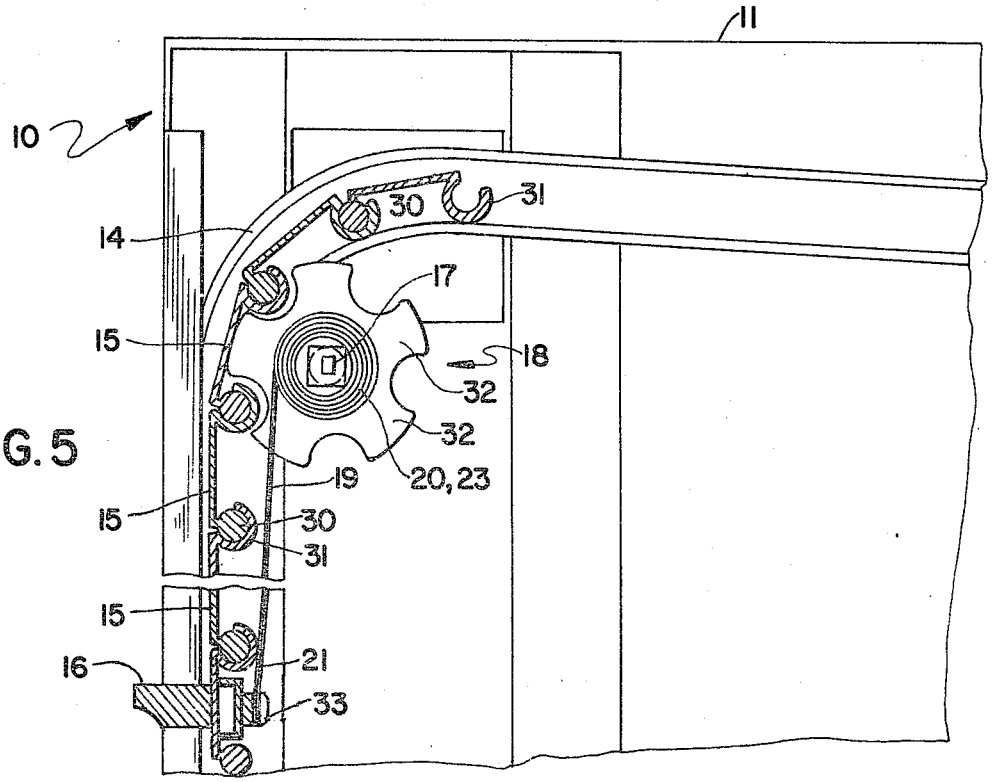
FIG. 5 is a partial sectional elevation view taken along the lines 5—5 in FIG. 2.

FIG. 5 shows a partial sectional view of the new tambour door 13 mounted in cabinet 10. The segments 15 of the door are distributed along the front of the cabinet then around the curved portion of track 14 and directed rearward in the horizontal portion of the track. Between two rod parts 30 is a pitch distance P for the sections of the door. Gear 18 has gear teeth 32 having a circular pitch distance corresponding to pitch P of the door, so that each gear tooth can rotate into the space between two coupling sections 31 of two slats of the door as shown. The particular gear 18 will rotate once for each five sections of the door to pass.

The spring 19 is shown with its lower part 21 secured to one of the bottom-most sections 15 of the door by connecting means 33, with the door handle 16 conveniently attached on the front of the door opposite the connection 33. The upper portion of the spring 20, spiraled about spool 23, is freely rotatable relative to the shaft 17 and the gear 18 which is secured on a shaft. As mentioned earlier, the significant characteristic of this spring is that it exerts constant force no matter how much it is unwound, so the end 21 of the spring urges the door 13 upward with the same force regardless of how far the door has been pushed up or down. This effectively counter-balances the door because the spring force is chosen to correspond to the weight of the door and thus hold it in a relatively stationary condition regardless of the door's position. As more of the door takes a horizontal position and its effective downward force is less, the spring's constant force may exceed the downward force thus driving the door further upward. Furthermore, because the door is effectively counter-balanced, only a small amount of manual force must be applied to handle 16 to overcome the counter-balanced door and cause it to move up or down. Correspondingly only a small amount of force is needed to stop the door from moving because of this counter-balanced condition. It would be possible to secure the upper part 20 of the spring about some shaft other than the one about which the gear 18 rotates, however shaft 17 is particularly convenient and compact for the tambour door and housing assembly shown. Obviously the door and the components of which it is made and the gear means for engaging them could take many different forms within the general scope of this invention. Thus it is to be understood that the embodiment described above is merely an illustrative example of the invention disclosed herein, and variations or modifications thereof, which lie within the scope of the appended claims, are fully contemplated.

I claim:

1. In a tambour door and housing assembly, the housing including a pair of spaced apart tracks defining a path having a generally vertical first section with top and bottom parts, a generally horizontal second section near the top part of said first section, and a curved third section interconnecting said first and second sections, and a tambour door having top and bottom parts and side edges slidably disposed in said tracks so that the door is movable along said path, said door comprising a plurality of longitudinal segments, each having opposite ends which define said side edges of the door, said segments being situated side-by-side with their adjacent edges pivotally engaged in hinge couplings, with a pitch distance P between said couplings, the improvement in combination therewith of a counter-balancing system comprising: a shaft mounted in said housing and situated generally parallel to said door segments, gear means comprising a first gear mounted rotatably on said shaft, the gear having teeth with a circular pitch distance between teeth corresponding to said pitch P of said door, said gear situated such that the teeth thereof each engage one door coupling successively as the door moves in the path and said gear rotates, and a Negator spring having an upper end coiled and freely rotatable about said shaft and a lower end secured to said bottom part of said door, whereby the door is subject to an essentially constant upward force from said spring generally counter-balancing the downward force due to the weight of the door, regardless of the location of the door along said path.

2. An assembly according to claim 1 wherein said shaft is generally parallel to said door segments and is situated near the curved section of said path, whereby said gear teeth engage said door couplings when said door segments are pivoted as they traverse said curved section of said path.

3. A tambour door and housing assembly according to claim 1 wherein the substantially constant force of the spring is generally equivalent to the downward force of the door tending to slide downward into said first section of said path.

4. An assembly according to claim 1 wherein the substantially constant force of the spring is slightly less than the downward force of the door tending to slide downward into said first section of said path.

5. An assembly according to claim 1 wherein said gear means further comprises a second gear similar to the first gear, said first and second gears being situated generally near sadi side edges of the door.

6. An assembly according to claim 1 wherein said door further comprises a handle secured to the lower part, at the same location as said lower end of said spring is secured, of said door.

7. An assembly according to claim 5 wherein said upper end of the spring is located axially on said shaft generally intermediate said first and second gears.

8. An assembly according to claim 1 further comprising a spool mounted on said shaft, said upper part of the spring being coiled about said spool so that said upper part of the spring is freely rotatable relative to said shaft.

9. In a tambour door and housing assembly, the housing including a pair of spaced apart tracks defining a path having a generally vertical first section with top and bottom parts, a generally horizontal second section near the top part of said first section, and a curved third section interconnecting said first and second sections, and a tambour door having top and bottom parts and side edges slidably disposed in said tracks so that the door is movable along said path, said door comprising a plurality of longitudinal segments, each having opposite ends which define said side edges of the door, said segments being situated side-by-side with their adjacent edges pivotally engaged in hinge couplings, with a pitch distance P between said couplings, the improvement in combination therewith of a counter-balancing system comprising: a shaft carried by said housing and situated generally parallel to said door segments, and a Negator spring having an upper end coiled and freely rotatable about said shaft and a lower end secured to said bottom part of said door, whereby the door is subject to an essentially constant upward force from said spring generally counter-balancing the downward force due to the weight of the door, regardless of the location of the door along said path.

10. In a tambour door and housing assembly, the housing including a pair of spaced apart tracks defining a curved path extending from an upper point to a lower point, and a tambour door having top and bottom parts and side edges slidably disposed in said tracks so that the door is movable along said path, said door comprising a plurality of segments, each having opposite ends which define said side edges of the door, said segments being situated side-by-side with their adjacent edges pivotally engaged in hinge couplings, with a pitch distance P between said couplings, the improvement in combination therewith of a counter-balancing system comprising: mounting means in said housing and situated generally adjacent to said path at a position remote from the lower point thereof, a Negator spring mounted by said mounting means and having an upper end coiled and freely rotatable at said mounting means and a lower end secured to said bottom part of said door, whereby the door is subject to an essentially constant upward force from said spring generally counter-balancing the downward force due to the weight of the door, regardless of the location of the door along said path.

* * * * *